US011631950B2

(12) United States Patent
Wimmer et al.

(10) Patent No.: US 11,631,950 B2
(45) Date of Patent: Apr. 18, 2023

(54) PLUG CONNECTOR HOUSING AND PLUG CONNECTION

(71) Applicant: Rosenberger Hochfrequenztechnik GmbH & Co. KG, Fridolfing (DE)

(72) Inventors: Martin Wimmer, Palling (DE); Christian Dandl, Fridolfing (DE); Markus Wallner, Saaldorf-Surheim (DE); Josef Krautenbacher, Fridolfing (DE); Andreas Gruber, Ainring (DE)

(73) Assignee: ROSENBERGER HOCHFREQUENZTECHNIK GMBH & CO. KG, Fridolfing (DE)

( * ) Notice: Subject to any disclaimer, the term of this patent is extended or adjusted under 35 U.S.C. 154(b) by 0 days.

(21) Appl. No.: 17/310,454

(22) PCT Filed: Feb. 4, 2020

(86) PCT No.: PCT/EP2020/052709
§ 371 (c)(1),
(2) Date: Aug. 4, 2021

(87) PCT Pub. No.: WO2020/169334
PCT Pub. Date: Aug. 27, 2020

(65) Prior Publication Data

US 2022/0123506 A1 Apr. 21, 2022

(30) Foreign Application Priority Data

Feb. 22, 2019 (EP) ..... 19158929

(51) Int. Cl.
*H01R 13/629* (2006.01)
*H01R 13/58* (2006.01)

(52) U.S. Cl.
CPC ... *H01R 13/62933* (2013.01); *H01R 13/5825* (2013.01)

(58) Field of Classification Search
None
See application file for complete search history.

(56) References Cited

U.S. PATENT DOCUMENTS

2018/0013235 A1 1/2018 Dupeux et al.

*Primary Examiner* — Ross N Gushi
(74) *Attorney, Agent, or Firm* — DeLio Peterson & Curcio LLC; Robert Curcio

(57) ABSTRACT

A plug connector housing having a housing, a sleeve arranged movably relative to the housing, and a lever, the lever being mounted on the housing for rotation about an axis of rotation extending perpendicularly to a plug-in direction of the plug connector housing, wherein the sleeve can be displaced in the plug-in direction in order to fix a cable by a rotary movement of the lever and the plug connector housing can be locked with a mating plug connector housing by the rotary movement of the lever, the housing having a cable-side end and a plug-side end and a strain relief element having an opening for passing through a cable being arranged at the cable-side end of the housing, and it being possible for the sleeve to at least partially be pushed onto the strain relief element in order to exert radial pressure on the strain relief element relative to the plug-in direction.

19 Claims, 16 Drawing Sheets

PLUG CONNECTOR HOUSING AND PLUG CONNECTION

BACKGROUND OF THE INVENTION

1. Field of the Invention

The invention relates to a plug connector housing, an arrangement with such a plug connector housing and a plug connection with such a plug connector housing and a corresponding mating plug connector housing.

2. Description of Related Art

A plug connector housing is typically attached by a screw connection or bayonet connection to a mating plug connector housing which is fixed in a housing wall of an electrical device. Such a plug connector housing is shown in the document US 2011/0189876 A1.

If a plurality of such plug connections consisting of the plug connector housing with corresponding mating plug connector housing are arranged parallel to one another in a tight space, the necessary rotary movement of the plug connector housing about an axis in the plug-in direction during fixing or releasing of the screw connection or bayonet connection by the installer is comparatively cumbersome.

A remedy is provided here by an attachment by means of a lever which is rotatable transversely to the plug-in direction of the plug connector housing. Such plug connector housings are usually used in distribution boxes on cell towers. In this field of application, high demands are placed on the cable-side end of the plug connector housing with regard to the fixing of the cable and the impermeability to moisture, dust and dirt. The impermeability of the plug-side end is also important.

U.S. Patent Publication No. 2018/0013235, titled "PLUG FOR CONNECTION TO A SOCKET OF AN ELECTRONIC EQUIPMENT BOX PANEL, HAVING MEANS OF SELF-ALIGNMENT", discloses a plug connector housing with a lever mounted transversely to the plug-in direction. A sealing element which is compressed by the closing process of the lever is provided on the plug side. In contrast, on the cable side a closure element is provided which is compressed by a screwing process, i.e., by a rotary movement of the closure element about an axis in the plug-in direction, in order to fix the cable and to provide sealing against the cable.

SUMMARY OF THE INVENTION

The object of the invention is to provide a plug connector housing in which the installer can dispense with a rotary movement of an element about an axis in the plug-in direction of the plug connector housing. It is also an object of the invention to provide an arrangement and a plug connection with such a plug connector housing.

This object is achieved by the subject matter of the independent claims. Advantageous embodiments of the plug connector housing are the subject matter of the dependent claims and are disclosed by the following description of the invention. An arrangement with such a plug connector housing is described, as well as a plug connection with such a plug connector housing.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
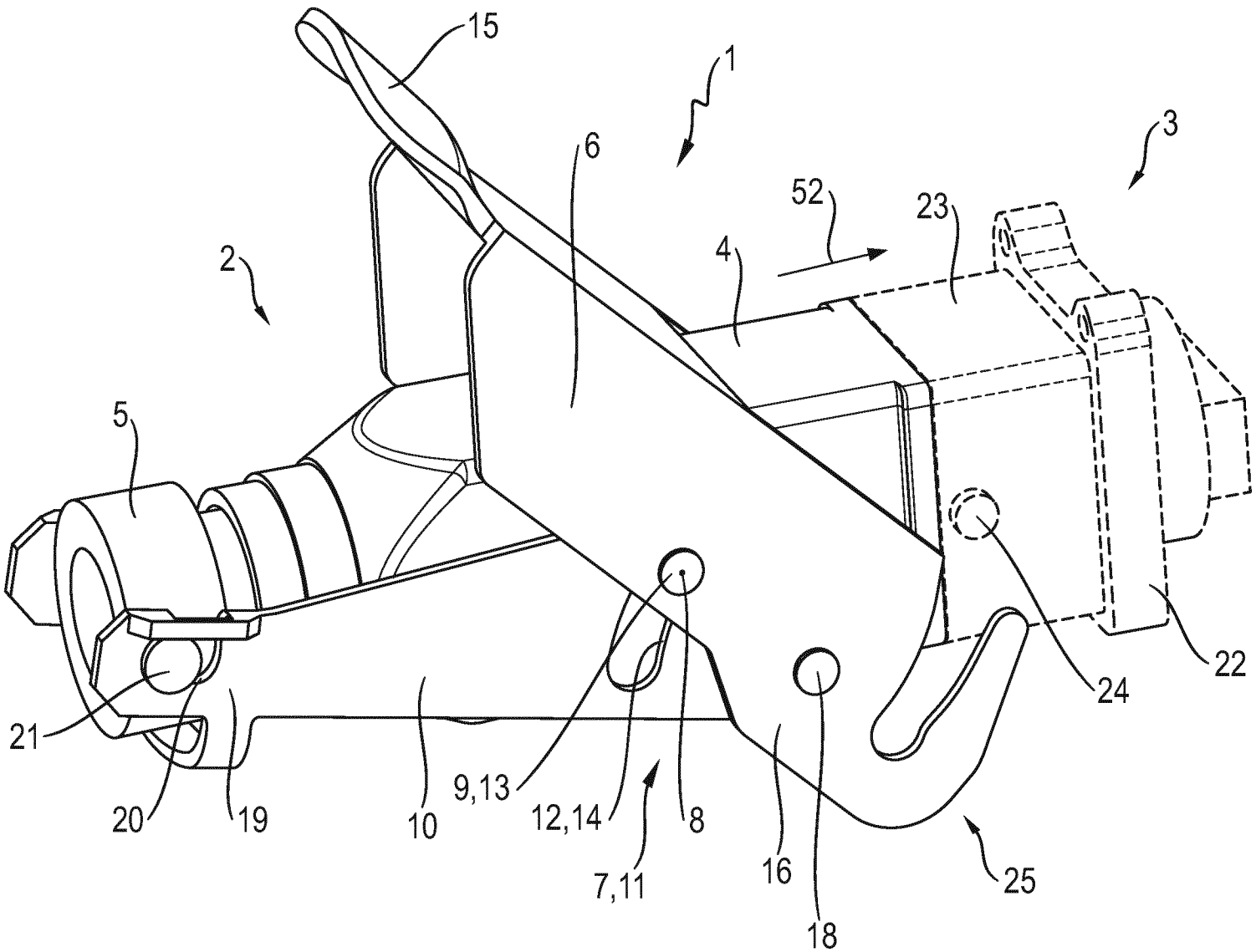
FIG. 1 shows a perspective view of a plug connection in the unlocked state.

In describing the preferred embodiment of the present invention, reference will be made herein to FIGS. 1-16 of the drawings in which like numerals refer to like features of the invention.

A plug connector housing is provided which comprises a housing, a sleeve arranged movably relative to the housing, and a lever. The lever is mounted on the housing so as to be rotatable about an axis of rotation running perpendicular to a plug-in direction of the plug connector housing, wherein the sleeve is displaceable in the plug-in direction for fixing a cable by means of a rotary movement of the lever, and wherein the plug connector housing is lockable with a mating plug connector housing by means of the rotary movement of the lever.

Because the sleeve is displaceable by means of the rotary movement of the lever and the plug connector housing is lockable with the mating plug connector housing by means of the same rotary movement of the lever, the fixing of the cable and the locking of the plug connector housing with the mating plug connector housing can be realized by means of a single rotary movement of the lever. The rotary movement thus causes a displacement of the sleeve in the plug-in direction to fix the cable and also causes locking of the plug connector housing with the mating plug connector housing.

In this way, mechanical fixing between the plug connector housing and the mating plug connector housing and also fixing of a cable by displacement of the sleeve can be advantageously achieved only by one single rotation of the lever.

The sleeve is arranged movably relative to the housing. Accordingly, the sleeve can be connected to the housing via at least one movable and/or rotatable element. The plug-in direction is the direction in which the plug connector housing and the mating plug connector housing are plugged together. In particular, the sleeve can be displaced axially in the longitudinal direction of the housing.

Fixing of the cable means that the cable can no longer be displaced relative to the sleeve and the housing. Sealing of the cable can also be achieved at the same time as the fixing of the cable. The cable can be in particular a fiber optic cable.

Furthermore, the housing has a cable-side end and a plug-side end. Furthermore, a strain relief element with an opening for passing a cable through is arranged at the cable-side end of the housing. The sleeve can be pushed at least partially onto the strain relief element in order to exert a radial pressure on the strain relief element relative to the plug-in direction.

The displacement of the sleeve takes place entirely or partially via the strain relief element. The sleeve exerts a radial pressure directly or indirectly on the strain relief element. The strain relief element can be compressed. The strain relief element then in turn exerts a radial pressure on the cable. The cable is advantageously fixed relative to the strain relief element, the sleeve and the housing. Since the cable is fixed to the strain relief element and the plug connector housing is locked with the mating plug connector housing, the cable cannot be displaced relative to the plug connector housing by pulling on the cable. Accordingly, the plug connector housing provides a strain relief for the cable.

Moreover, the strain relief element can seal the plug connector housing against moisture, dust, and dirt.

According to one embodiment of the plug connector housing, the sleeve can be displaced in a direction toward the housing to exert radial pressure on the strain relief element. Alternatively, the sleeve can be displaced in a direction away from the housing in order to exert the radial pressure on the strain relief element. In principle, the sleeve and the strain relief element can be designed in such a way that sliding the sleeve away from the housing fixes the cable or pushes the sleeve onto the housing to fix the cable.

As the sleeve moves away from the housing, the sleeve performs an axial movement away from the housing. Alternatively, as the sleeve approaches the housing, the sleeve performs an axial movement toward the housing.

The plug-in direction and the mating plug-in direction are in particular parallel to the longitudinal axis of the plug connector housing. Furthermore, the plug-in direction and the mating plug-in direction are in particular parallel to the axis of the cable if the cable runs in a straight line. The sleeve can be displaced in the plug-in direction or in the mating plug-in direction.

The plug connector housing can also be angled. In this case, the cable can also be angled.

According to a further embodiment of the plug connector housing an inner lateral surface of the sleeve is tapered. Additionally or alternatively, an outer lateral surface of the strain relief element is tapered. The surface of a volume that is created by rotation of a graph of a function about a coordinate axis is designated as a lateral surface. The fact that a lateral surface is tapered means that, with a cross section of the lateral surface perpendicular to the coordinate axis, the circumference of the cross section decreases in one direction along the coordinate axis.

In particular, the inner lateral surface of the sleeve and/or the outer lateral surface of the strain relief element can be conical, i.e., inner lateral surface of the sleeve and/or the outer lateral surface of the strain relief element form the lateral surface of a truncated cone.

According to a further embodiment of the plug connector housing, the plug connector housing has a gear mechanism in order to convert the rotation of the lever into the displacement of the sleeve. The gear mechanism is a mechanical device which comprises the lever and at least one further element. The gear mechanism converts a force on the lever into a force on the sleeve. The transmission of force between the lever and the at least one further element takes place in particular via a force-fit connection and/or via a form-fit connection.

According to a further embodiment of the plug connector housing, the plug connector housing comprises the gear mechanism in order to convert the rotary movement of the lever into the locking of the plug connector housing with the mating plug connector housing. Advantageously, a force on the lever can also cause locking of the plug connector housing with the mating plug connector housing.

According to a further embodiment of the plug connector housing, the gear mechanism has a transmission ratio such that it causes a release of the cable by means of displacement of the sleeve before unlocking of the plug connector housing from the mating plug connector housing or a loosening of the cable by displacement of the sleeve after unlocking of the plug connector housing from the mating plug connector housing.

The transmission ratio of the gear mechanism is predetermined by the mechanical design of the gear mechanism and determines the ratio of the amount of rotation of the lever to the displacement distance of the sleeve and the ratio of the amount of rotation of the lever to the distance covered by a locking element. In particular, the specific design of the individual elements involved in the gear mechanism, for example the locking element, is also critical for the correct choice of the corresponding transmission ratio. If the locking element is designed as a hook, then the length of the hook element which, for example, engages around a pin, is also critical.

The transmission ratio may be chosen such that first of all the strain relief is released by the displacement of the sleeve. As soon as the locking between the plug connector housing and the mating plug connector housing is released, the plug connector housing can be pushed back on the cable. The actual cable connection can then be released.

However, if the locking between the plug connector housing and the mating plug connector housing were released first, then tightening on the plug connector housing would pull on the actual cable connection, since the plug connector housing is still connected to the cable via the strain relief element and the sleeve.

It may also be desirable, however, that the plug connector housing is first disengaged from the mating plug connector housing, and then the strain relief is released by the displacement of the sleeve.

According to a further embodiment of the plug connector housing, the gear mechanism has a cam mechanism. The cam mechanism further comprises a curved guide and a guide element interacting with the curved guide. Cam mechanisms are gear mechanisms of which the output movement is produced by continuous scanning of a curved guide which is rotatably mounted or guided in a straight line with the aid of a guide element which is rotatably mounted or guided in a straight line.

According to a further embodiment of the plug connector housing the curved guide is designed as a backdrop. The guide element is also designed as a pin. The slot is an elongated, curved opening. The pin is guided in the slot or the slot is guided along the pin.

In particular, the lever can be supported by means of a pin as center of rotation. Furthermore, a connecting element is rotatably connected at one end to the sleeve and rotatably connected at the other end to the lever. Between the two ends the connecting element has a slot which engages around the pin which serves as a center of rotation of the lever.

According to a further embodiment of the plug connector housing the curved guide is designed as a curved contour. The guide element is also designed as a pin.

The contour of a wedge which exerts a force on the pin when it interacts with the pin is also to be understood as a curved contour within the meaning of the invention. In particular, the lever can have a curved contour on the actuation side and the guide element can be designed as a pin on the sleeve. Alternatively, the lever, the pin and the sleeve can have a structure with a curved contour.

According to a further embodiment of the plug connector housing the gear mechanism has a crank mechanism. The crank mechanism further comprises at least one connecting element which is rotatably attached to the lever at a first end and is rotatably attached to the sleeve at a second end.

In particular, the crank mechanism can also have two, three, four, five or six connecting elements.

According to a further embodiment of the plug connector housing the at least one connecting element is attached to the lever by the first end on an actuation side of the lever relative to the axis of rotation of the lever. Alternatively, the at least one connecting element is fastened to the lever by the first end on a non-actuation side of the lever relative to the axis of rotation of the lever. The actuation side of the lever relative to the axis of rotation of the lever is the side on which a user actuates the lever. On the other hand, the non-actuation side of the lever relative to the axis of rotation of the lever is the side on which a user does not actuate the lever.

According to a further embodiment of the plug connector housing, the gear mechanism has a gear train mechanism. Furthermore, the gear train mechanism comprises at least one wheel and at least one wheel element interacting with the wheel. Gear train mechanisms are in particular gear trains or friction gear trains. In gear trains the wheel is a gear wheel and the wheel element is a gear wheel element. The gearwheel element can in particular be designed as a toothed rack. The lever preferably has the gear wheel and the toothed rack transmits the force to the sleeve.

All gear mechanisms in which the transmission of torque and movement is based on the principle of frictional connection (static friction) between the wheel and the wheel element are designated as friction gear trains.

According to a further embodiment of the plug connector housing, the locking means has a hook for engaging around a pin or a spring cage having at least one spring element for engaging in a recess of a sleeve of the mating plug connector housing.

The locking means can have a detent element and a corresponding counterpart detent element (abutment). The detent element is designed in particular as a hook and the corresponding counterpart detent element is designed in particular as a pin.

In this case the hook is arranged in particular on the non-actuation side of the lever at the end of the lever. The pin is in particular attached to a sleeve attached to the mating plug connector housing. Alternatively, the pin can also be attached to the lever and the hook can be attached to the sleeve of the mating plug connector housing.

Together with the spring cage, the locking means has in particular a further sleeve which is at least partially displaceable over the spring cage in order to prevent the at least one spring element from loosening from the recess in the sleeve of the mating plug connector housing. The further sleeve is connected to the gear mechanism.

In addition, an arrangement is provided which has a plug connector housing, as described above or below, and a connector. The actual cable connection is implemented by the plug connector with a corresponding mating plug connector.

Furthermore, a plug connection is provided with a plug connector housing, as described above or below, and with a mating plug connector housing for connection to the plug connector housing.

The embodiments and features described for the proposed plug connector housing apply correspondingly and conversely to the proposed arrangement and proposed plug connection.

Further possible implementations of the invention also include combinations, which are not explicitly mentioned, of features described above or below. Individual aspects can also be added as improvements or additions to the particular basic form of the invention.

The invention is explained below with reference to the drawings. In the figures, identical or functionally identical elements have been provided with the same reference numerals. It should also be noted that the representations in the figures are not necessarily to scale.

FIG. 1 shows a perspective view of a plug connection 1 in the unlocked state. The plug connection 1 has a plug connector housing 2 and a mating plug connector housing 3 that can be connected to the plug connector housing 2. The plug connector housing 2 is plugged together with the mating plug connector housing 3 but not locked therewith. The mating plug connector housing 3 is shown in dashed lines in FIG. 1.

The plug connector housing 2 comprises a housing 4, a sleeve 5 arranged movably relative to the housing 4 and a lever 6. The lever 6 is mounted on the housing 4 so as to be rotatable about an axis of rotation 8. The axis of rotation 8 runs perpendicular to a plug-in direction of the plug connector housing 2. The plug-in direction is the direction in which the plug connector housing 2 is plugged into the mating plug connector housing 3. The plug-in direction corresponds to the direction of the arrow 52 in FIG. 1. The axis of rotation 8 is formed by a first pin 9.

The plug connector housing 2 has a gear mechanism 7. A rotary movement of the lever 6 can be converted into a displacement of the sleeve 5 by means of the gear mechanism 7. The sleeve 5 can be displaced in the plug-in direction by means of the rotary movement of the lever 6. A cable can be fixed due to the displacement of the sleeve 6 in the plug-in direction. Furthermore, the plug connector housing 2 can be locked with the mating plug connector housing 3 by means of the rotary movement of the lever 6. The gear mechanism 7 thus also serves to convert the rotary movement of the lever 6 into the locking of the plug connector housing 2 with the mating plug connector housing 3.

The gear mechanism 7 comprises the lever 6, the first pin 9 and a connecting element 10. The gear mechanism 7 includes a cam mechanism 11. The cam mechanism 11 also has a curved guide 12 and a guide element 13, wherein the guide element 13 interacts with the curved guide 12. More precisely, the curved guide 12 is designed as a slot 14. The slot 14 is an elongated, curved opening in the connecting element 10. On the other hand, the first pin 9 constitutes the guide element 13. The pin 9 is guided in the slot 14.

The lever 6 includes an actuation side 15 and a non-actuation side 16. The actuation side 15 is the side relative to the axis of rotation 8 on which an installer actuates the lever 6. The connecting element 10 is rotatably connected at a first end 17 via a second pin 18 to the non-actuation side 16 of the lever 6. Furthermore, the connecting element 10 is rotatably connected to the sleeve 5 at a second end 19 by means of an opening 20. For this purpose a third pin 21, which is connected to the sleeve, protrudes into the opening 20 of the connecting element 10. The slot 14 is arranged between the first end 17 and the second end 19.

The mating connector housing 3 has a fastening element 22 for attachment to a housing of an electrical device and a sleeve 23. A fourth pin 24 is arranged on the sleeve 23. The connecting element 10 comprises a hook 25 on the non-actuation side 16. The hook 25 serves to engage around the fourth pin 24 and thus to lock the plug connector housing 2 with the mating plug connector housing 3.

If an installer actuates the lever 6 on the actuation side 15 in the direction of the housing 4, then the lever 6 rotates about the axis of rotation 8, so that the non-actuation side 16 of the lever also moves toward the housing 4. The hook 25 engages around the fourth pin 24 so that the plug connector housing 2 is locked with the mating plug connector housing 3. Furthermore, the movement of the non-actuation side 16 of the lever 6 is transmitted via the second pin 18 to the first end 17 of the connecting element 10. Due to the interaction of the slot 14 with the first pin 9, the connecting element 10 is moved in the plug-in direction due to the actuation of the lever 6. The movement of the connecting element 10 is transmitted to the sleeve 5 via the opening 20 of the connecting element 10 and the third pin 21. Tightening of the sleeve 5 in the plug-in direction causes fixing of the cable. Accordingly, by means of a single rotary movement on the lever 6, the plug connector housing 2 is locked with the mating plug connector housing 3 and the cable is fixed by means of the displacement of the sleeve 5.

Alternatively, the connection between the opening 20 and third pin 21 can also be reversed, i.e., the opening is located in the sleeve 5 and the pin is located in the connecting element 10. Likewise, in an alternative, the hook could be attached to the sleeve 23 of the mating plug connector housing 3 and a pin could be attached to the non-actuation side 16 of the lever 6 in order to form a lock with the hook.

Figure 2:
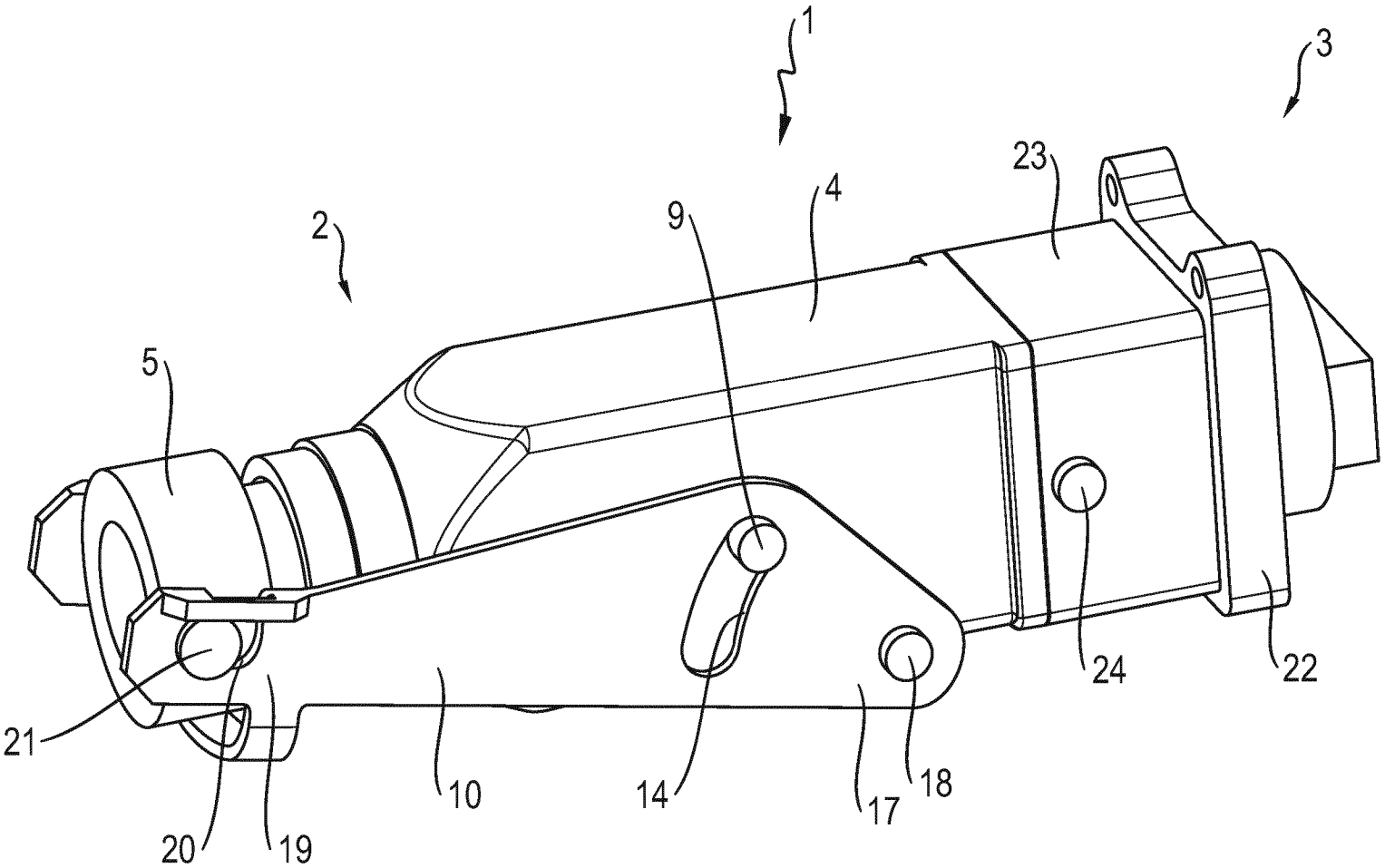
FIG. 2 shows a perspective view of the plug connection from FIG. 1 without the lever.

FIG. 2 shows a perspective view of the plug connection 1 from FIG. 1 without the lever 6. As can be seen from FIG. 2, when the lever 6 is in the open position the connecting element 10 is arranged in such a way that the first pin 9 is located at the very top in the slot 14.

Figure 3:
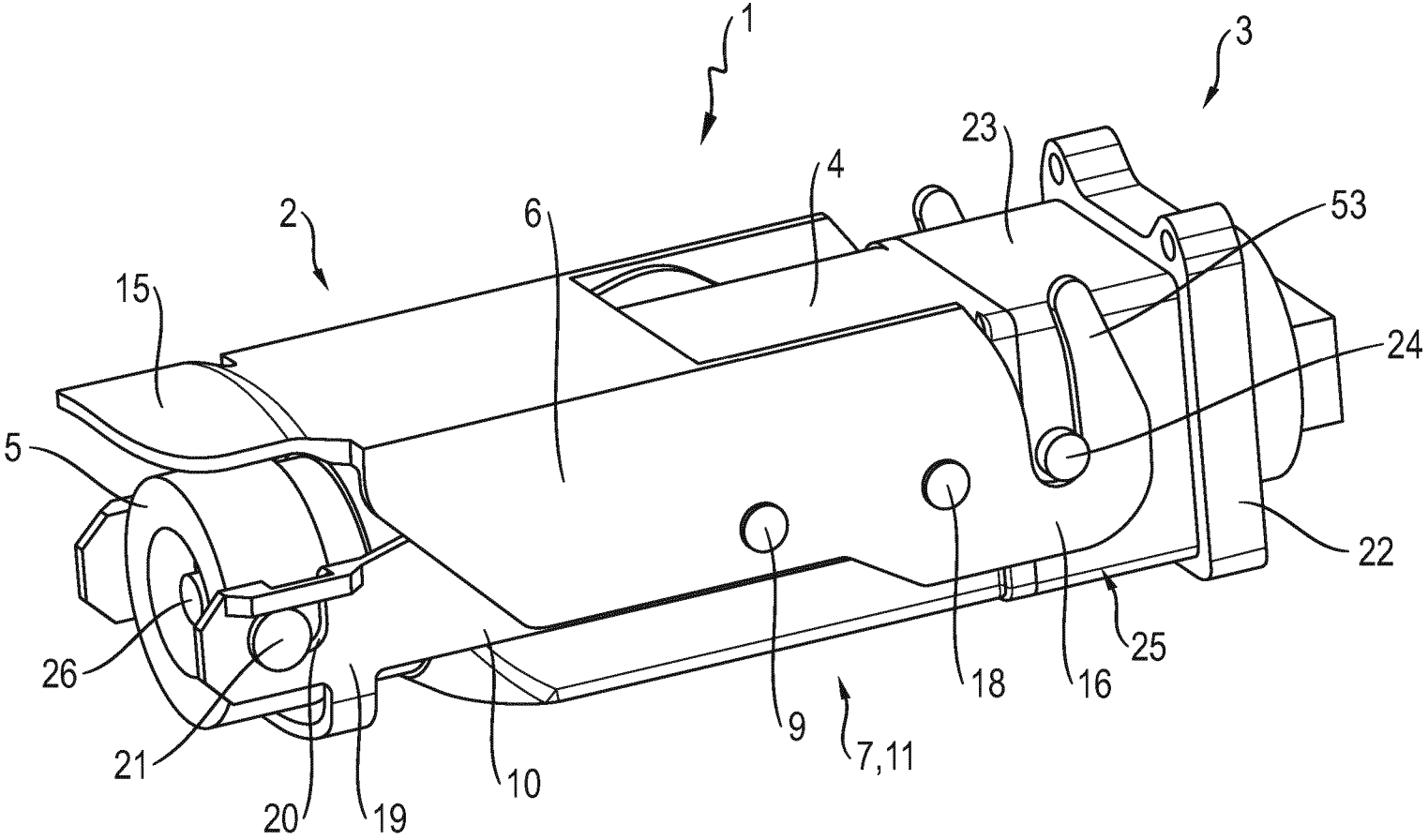
FIG. 3 shows a perspective view of the plug connection from FIG. 1 in the locked state.

FIG. 3 illustrates a perspective view of the plug connection 1 from FIG. 1 in the locked state. The lever 6 is located in the closed position. FIG. 3 also shows a cable 26, or more precisely only a cable section, since the cable 26 protrudes from the plug connector housing 2 and does not simply end at the end of the plug connector housing 2.

The gear mechanism 7 has a corresponding transmission ratio so that the cable 26 is released first and only then is the locking of the plug connector housing 2 with the mating plug connector housing 3 released. The transmission ratio is influenced by some parameters. Such parameters of the connecting element 10 are the distance from the slot 14 to the opening 20, the geometric shape of the slot 14 and the distance from the slot 14 to the second pin 18. Such parameters of the lever 6 are the distance from the first pin 9 to the second pin 18 and the distance from the second pin 18 to the hook 25. The design of the elements involved, for example the hook 25, facilitates the attachment scheme. As can be seen in FIG. 3, the hook 25 has a very long hook element 53. Accordingly, due to the long hook element 53, the locking is maintained for a long time during opening of the lever 6. Only after the lever 6 is very wide open are the plug connector housing 2 and the mating plug connector housing 3 released.

Figure 4:
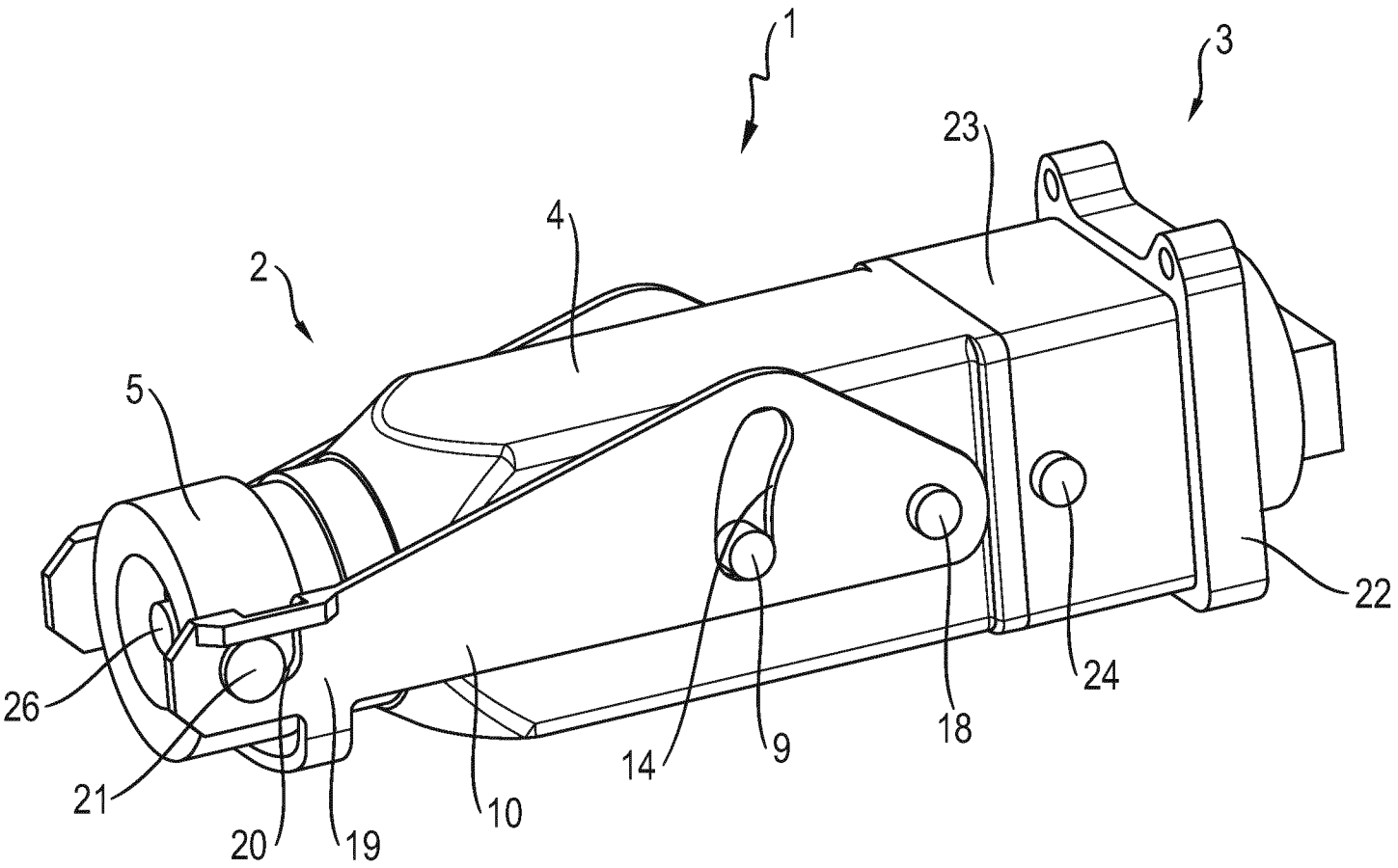
FIG. 4 shows a perspective view of the plug connection from FIG. 3 without the lever.

FIG. 4 shows a perspective view of the plug connection 1 from FIG. 3 without the lever 6. As can be seen from FIG. 4, in contrast to FIG. 2, when the lever 6 is closed the connecting element 10 is arranged in such a way that the first pin 9 is arranged at the very bottom in the slot 14.

Figure 5:
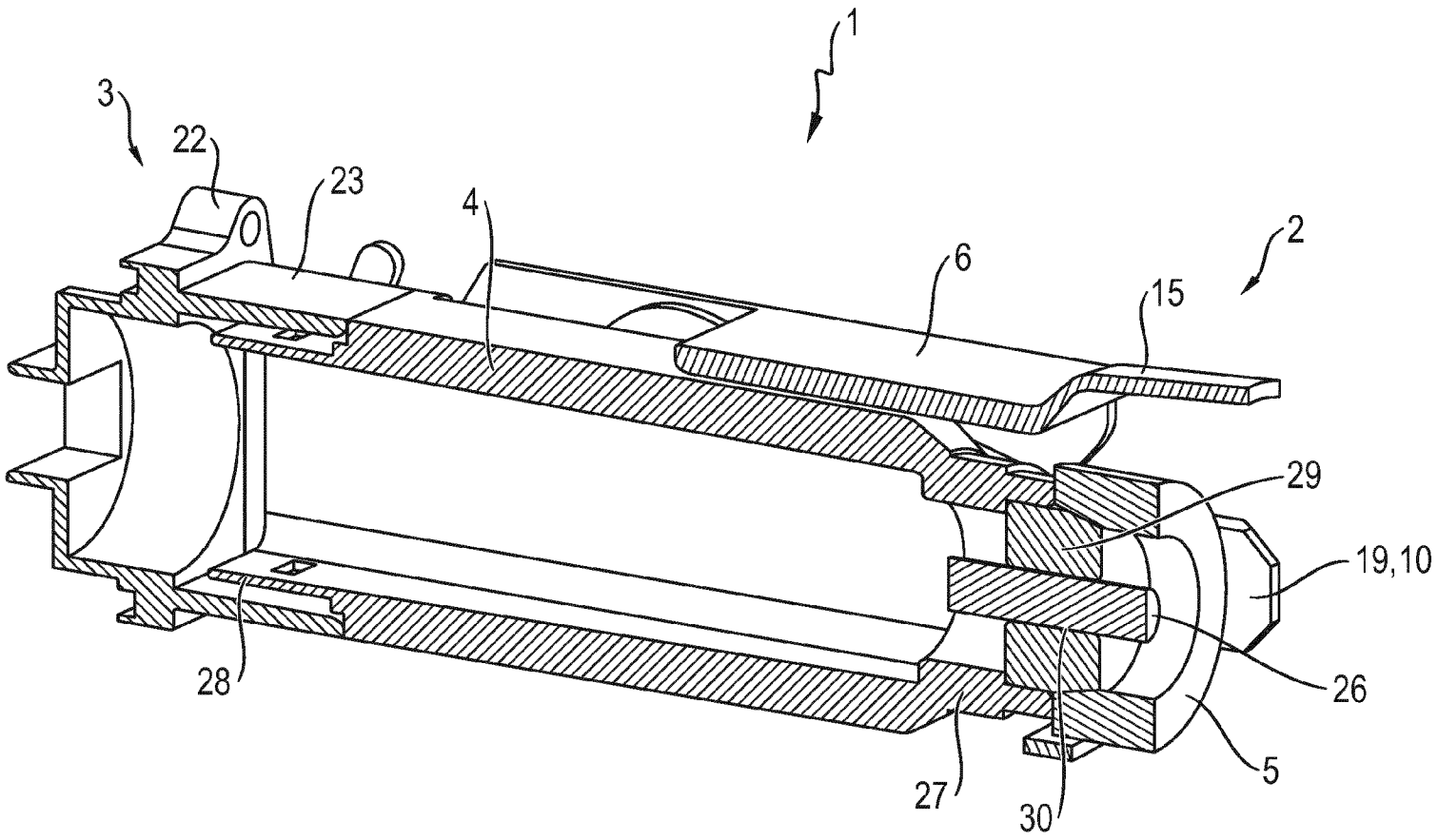
FIG. 5 shows a perspective interior view of a half-model of the plug connection from FIG. 3.

FIG. 5 shows a perspective inside view of a half model of the plug connection 1 from FIG. 3. FIG. 5 shows the housing 4 with a cable-side end 27 of the housing 4 and with a plug-side end 28 of the housing 4. A strain relief element 29 with an opening 30 for passing a cable 26 through is arranged at the cable-side end 27. The sleeve 5 is partially pushed over the strain relief element 29. The mechanism for fixing the cable 26 is described in more detail in FIG. 6.

Alternatively, the plug connector housing 2 shown in FIGS. 1 to 5 also has a crank mechanism. In this case the opening identified by the reference numeral 14 is merely an elongated opening which has no guiding function whatsoever. The displacement of the sleeve 5 via the connecting element 10 takes place only in that the connecting element 10 is rotatably connected to the lever 6 via the pin 18.

Figure 6:
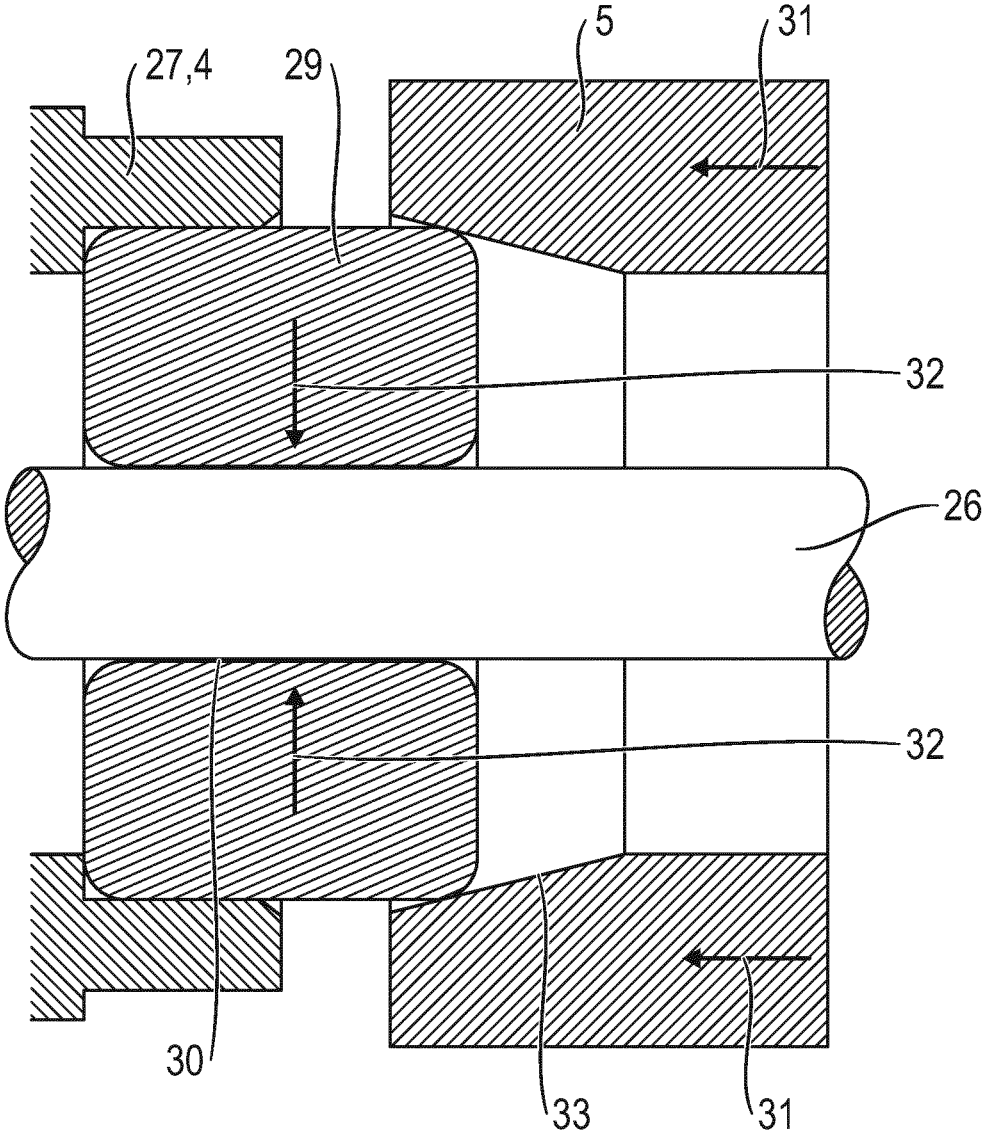
FIG. 6 shows a schematic sectional view of the cable-side end of the housing of a plug connector housing.

FIG. 6 shows a schematic sectional view of the cable-side end 27 of the housing 4 of the plug connector housing 1 from FIG. 5. The cable-side end 27 of the housing 4, the strain relief element 29, the sleeve 5 and the cable 26 can be seen. The strain relief element 29 is arranged on the cable-side end 27 of the housing 4. The strain relief element 29 also has an opening 30 through which the cable 26 is passed. The sleeve 5 is pushed at least partially onto the strain relief element 29 in the direction of the arrows 31, i.e., in the direction of the housing 4. The strain relief element 29 can be compressed. In any case, the sleeve 5 exerts a radial pressure on the strain relief element 29. The direction of the arrows 31 corresponds to the plug-in direction of the plug connector housing 2. The strain relief element 29 in turn exerts a radial pressure on the cable 26. This radial pressure takes place in the direction of the arrows 32. Accordingly, the cable 26 is fixed either by a force fit or by a form fit. At the same time, the housing 4 can also be sealed thereby.

The sleeve 5 has an inner lateral surface 33 which extends at least over part of the entire inner surface of the sleeve 5. This inner lateral surface 33 is tapered. In the direction of the arrows 31, the cross section of the inner lateral surface 33 becomes ever larger, perpendicular to the direction of the arrows. In particular, the inner lateral surface has a conical shape.

Alternatively, the sleeve 5 could have a cylindrical inner lateral surface and the strain relief element 29 could have an outer lateral surface, which is tapered, in particular conical.

Figure 7:
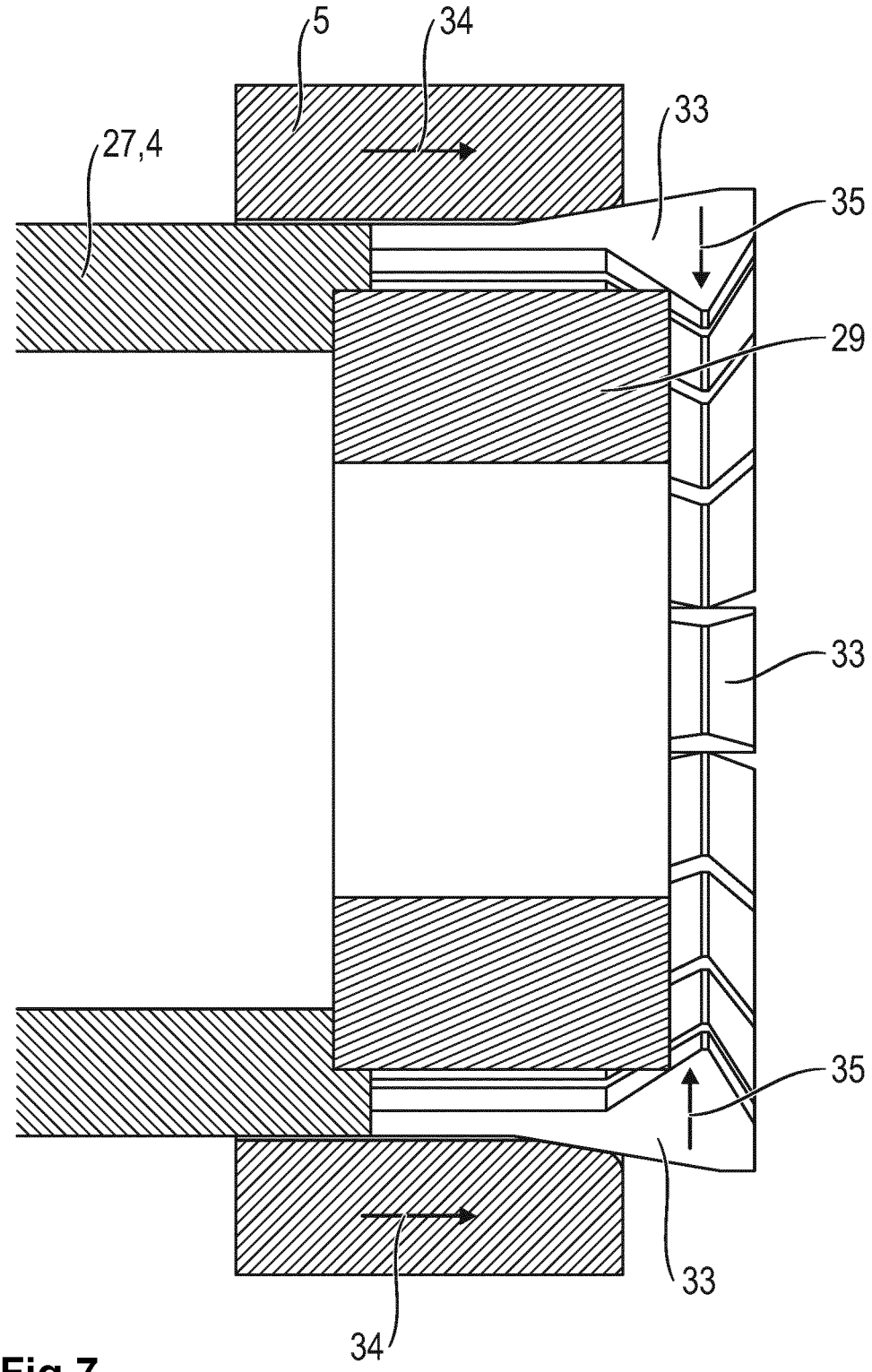
FIG. 7 shows a schematic sectional view of the cable-side end of the housing of a further plug connector housing.

FIG. 7 shows a schematic sectional view of the cable-side end 27 of the housing 4 of a further plug connector housing 1. The sleeve 5, the strain relief element 29 and resilient elements 33 are also shown. In this embodiment, the sleeve 5 is pushed away from the housing 4 in the direction of the arrows 34 by means of the gear mechanism 7. The direction of the arrows 34 corresponds to the mating plug-in direction. As a result, the sleeve 5 exerts a radial pressure on the resilient elements 33. The resilient elements 33 in turn exert a radial pressure on the strain relief element 29 in the direction of the arrows 35. The cable 26 (not shown in FIG. 7) is fixed thereby. Thus at the same time the housing 4 can also be sealed.

Alternatively, the corresponding elements can be also transformed in FIGS. 6 and 7. In this way, according to the principle of FIG. 6, a plug connector housing 2 would be obtained in which a sleeve 5 leading away from the housing 4 fixes a cable 26. Likewise, according to the principle of FIG. 7, a plug connector housing 2 with resilient elements 33 would be obtained, in which a sleeve 5 leading to the housing 4 fixes a cable 26.

Figure 8:
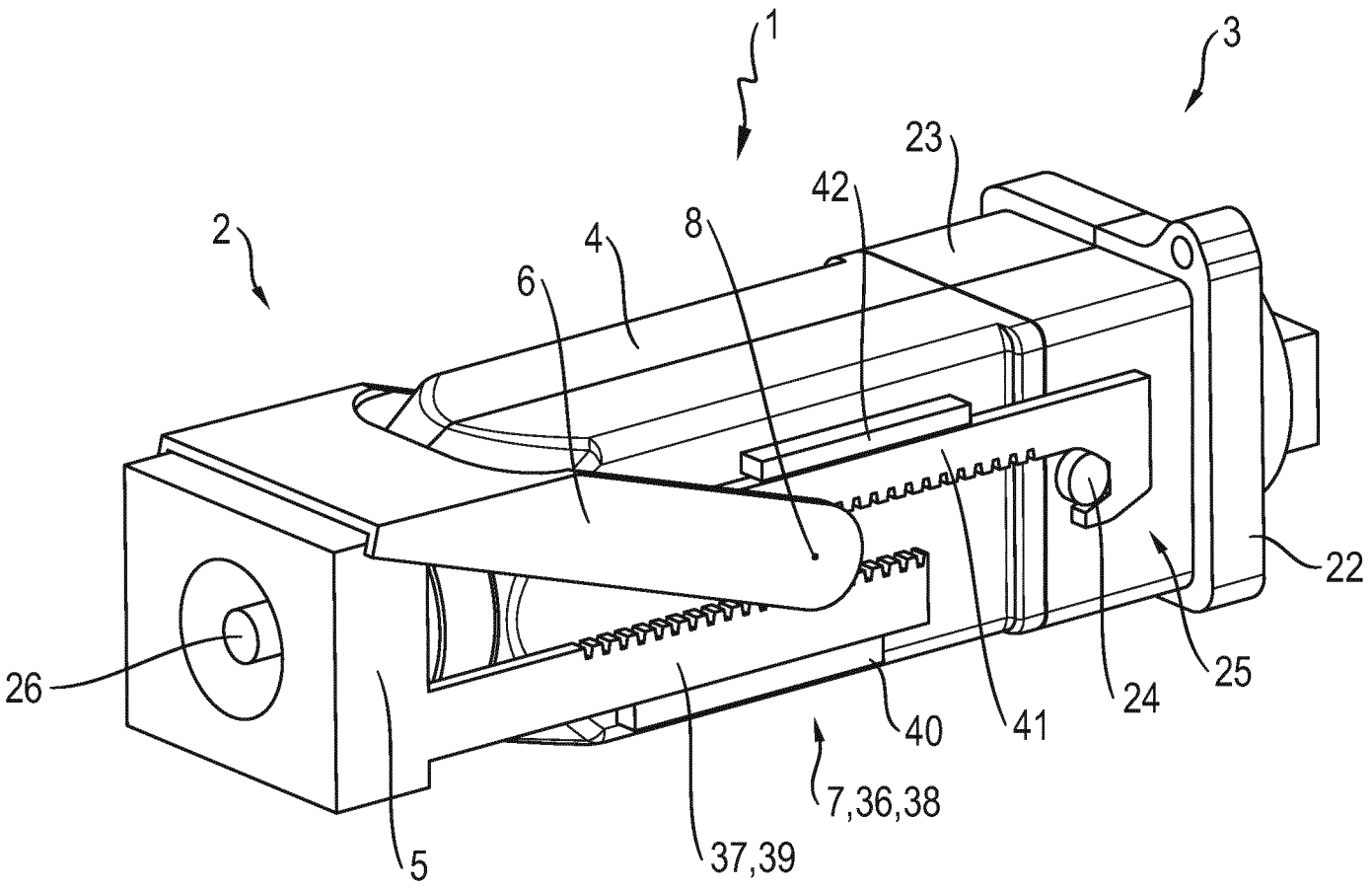
FIG. 8 shows a perspective view of a plug connection in the locked state.

FIG. 8 shows a perspective view of a plug connector 1 in the locked state. A plug connector housing 2 and a mating plug connector housing 3 can be seen. The plug connector housing 2 has a gear mechanism 7. In this case, the gear mechanism 7 comprises a gear train mechanism 36 which has a wheel and a wheel element 37. The gear train mechanism 36 is more precisely a gear train 38. Thus the wheel is designed as a gear wheel. The gear wheel is attached to the lever 6 and has the same axis of rotation 8 as the lever 6. Since the gear wheel is arranged behind the lever 6, it cannot be seen in FIG. 8.

The wheel element 37 is designed as a gear wheel element, more precisely as a toothed rack 39. The toothed rack 39 is displaceable parallel to a guide element 40. Accordingly, the guide element 40 predetermines the direction of movement of the toothed rack 39.

When the lever 6 is closed, the gear wheel rotates about the axis of rotation 8 and drives the toothed rack 39 along the guide element 40 toward the mating plug connector housing 3. Thus the sleeve 5 connected to the toothed rack 39 is moved toward the housing 4 in order to fix the cable 26. In addition, the closing movement of the lever 6 by means of the gear wheel moves a further toothed rack 41 along a further guide element 42 in the direction of the sleeve 5, that is, in the mating plug-in direction. A hook 25 which engages around a pin 24 in order to lock the plug connector housing 2 with the mating plug connector housing 3 is located at the end of the further rack 41. Thus, with one single rotary movement of the lever 6, the cable 26 can be fixed and the plug connector housing 2 can be locked with the mating plug connector housing 3.

The gear train 38 is designed so that, when the lever 6 is opened, the fixing of the cable 26 is first released and only then is the plug connector housing 2 unlocked from the mating plug connector housing 3.

Figure 9:
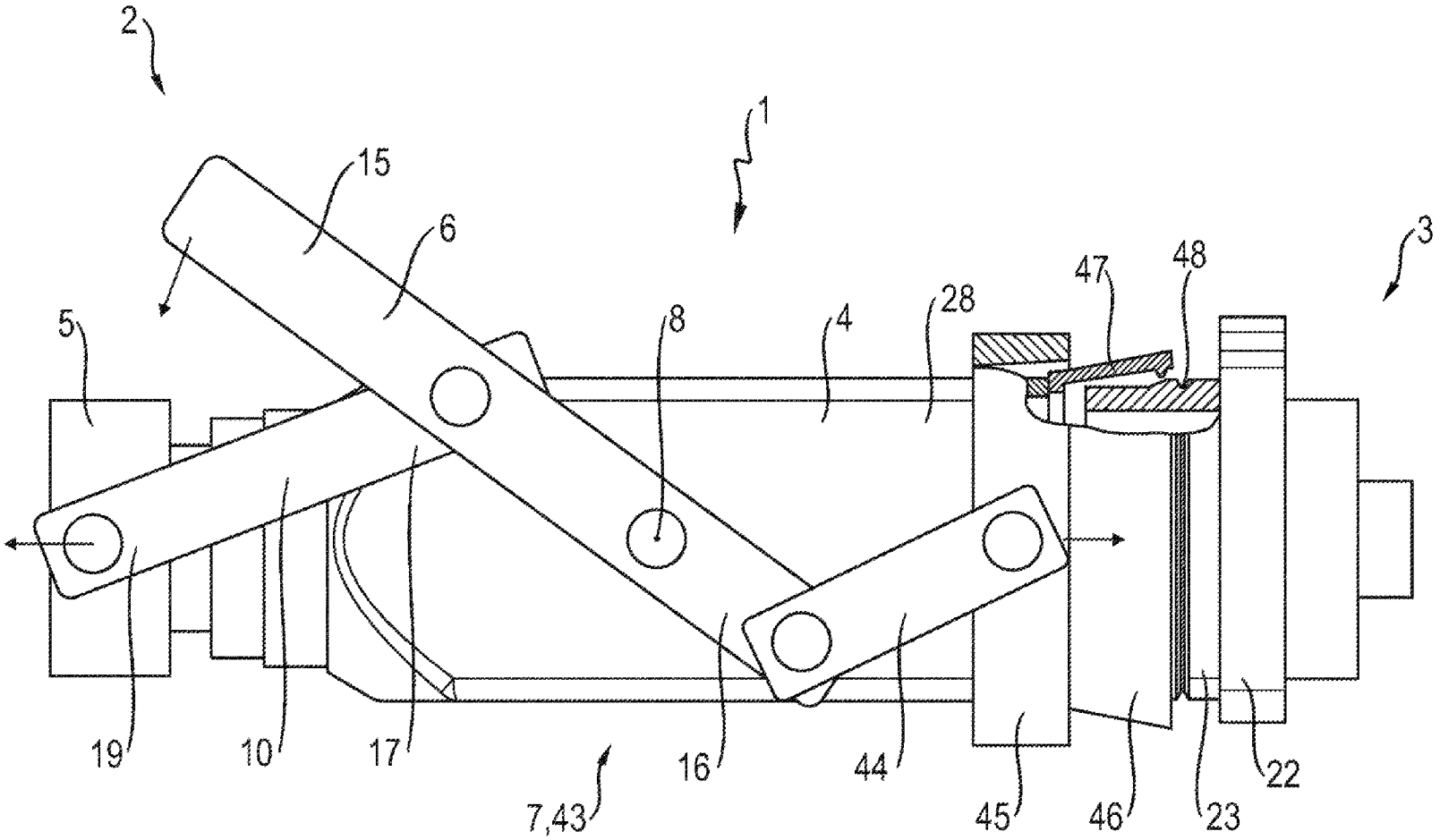
FIG. 9 shows a side view and partial sectional view of a plug connection in the unlocked state.

FIG. 9 shows a side view and a partial sectional view of a plug connection 1 in the unlocked state. The plug connection 1 has a plug connector housing 2 and a mating plug connector housing 3. The plug connector housing 2 has a gear mechanism 7. The gear mechanism 7 comprises a crank mechanism 43, which in turn has a connecting element 10. The connecting element 10 is rotatably fastened to the lever 6 by a first end 17. Furthermore, the connecting element 10 is rotatably fastened to the sleeve 5 by a second end 19. The lever 6 is mounted on the housing 4 so as to be rotatable about the axis of rotation 8. In this case, the connecting element 10 is fastened to the lever 6 with the first end 17 on an actuation side 15 of the lever 6 relative to the axis of rotation 8 of the lever 6.

The crank mechanism 43 comprises a further connecting element 44 which is rotatably attached to a non-actuation side 16 of the lever 6 and is rotatably attached to a further sleeve 45. A spring cage 46, which has at least one spring element 47, is arranged at the plug-side end 28 of the housing 4.

When the lever 6 is closed, the sleeve 5 is pushed in the mating plug-in direction away from the plug housing 4, and thus fixes the cable 26. Furthermore, the further sleeve 45 is pushed over the spring cage 46 by the closing movement of the lever 6. As a result, the individual spring elements 47, which are latched into recesses 48 in the sleeve 23 of the mating plug connector housing 3, can no longer be released. Thus the plug connector housing 2 and the mating plug connector housing 3 are locked with one another.

Figure 10:
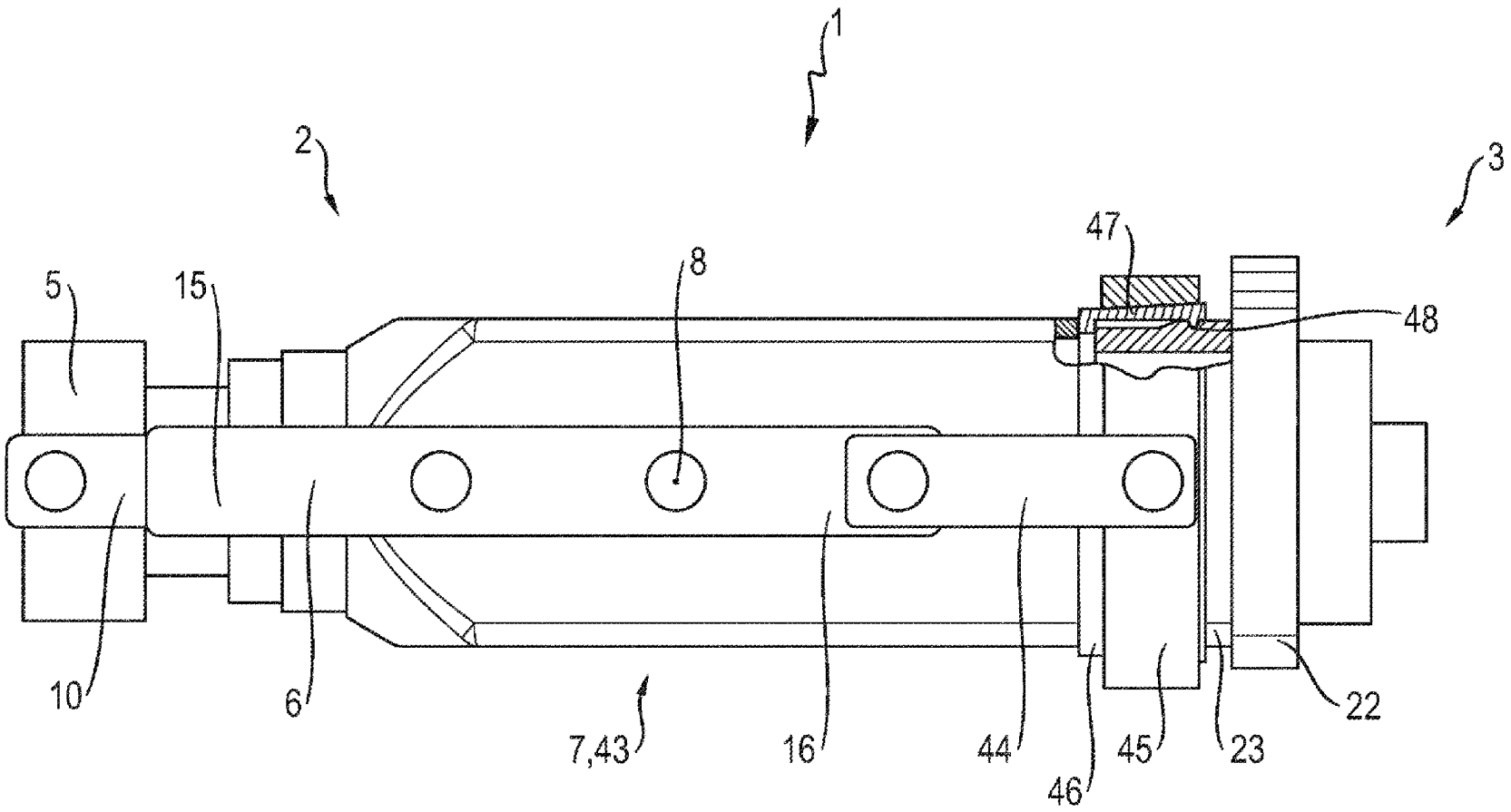
FIG. 10 shows a side view and partial sectional view of the plug connection from FIG. 9 in the locked state.

FIG. 10 illustrates a side view and partial sectional view of the plug connection 1 from FIG. 9 in the locked state.

Figure 11:
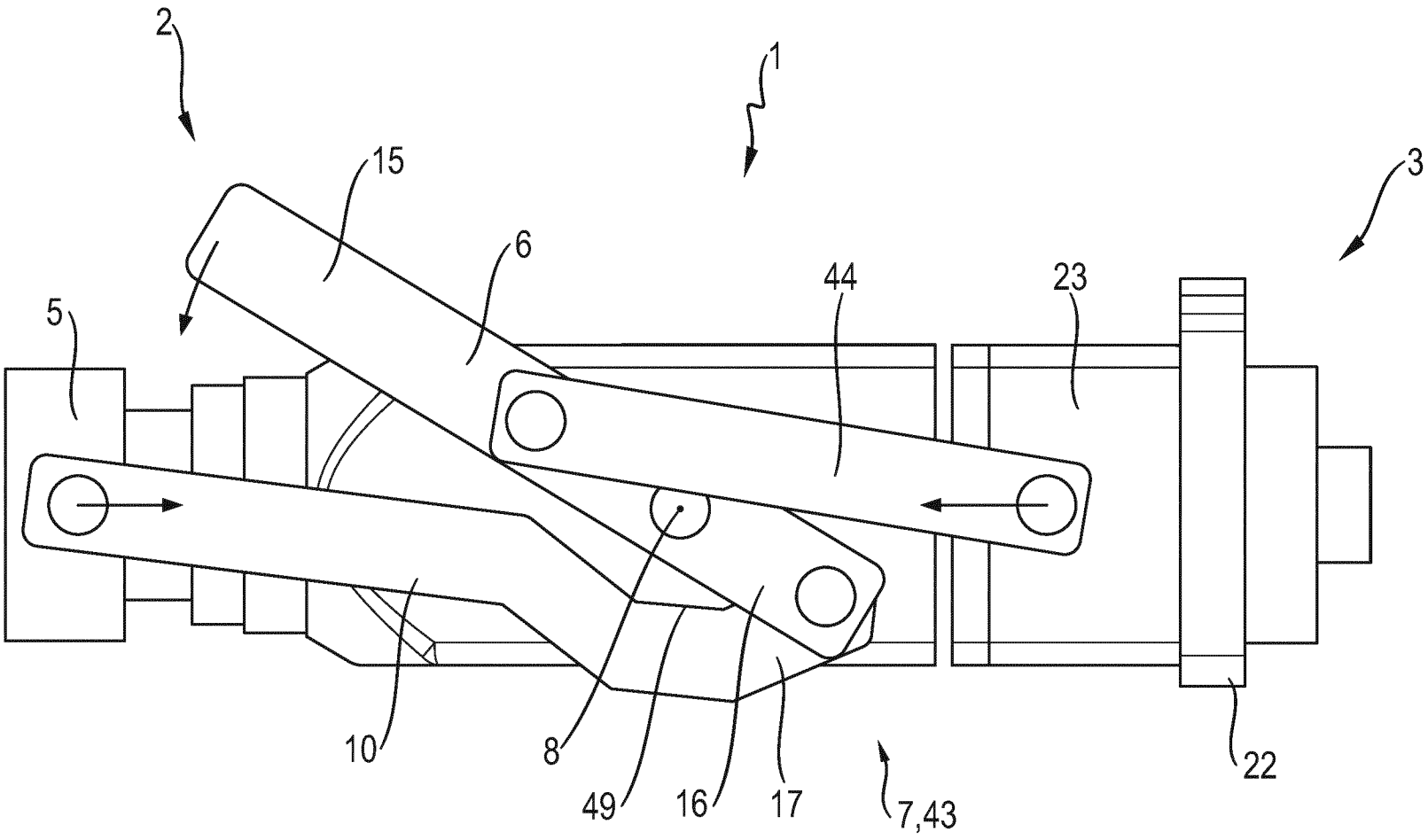
FIG. 11 shows a side view of a plug connection in the unlocked state.

FIG. 11 shows a side view of a plug connection 1 in the unlocked state. In contrast to the embodiment shown in FIGS. 9 and 10, in the embodiment in FIG. 11 the connecting element 10 is attached to the lever 6 by the first end 17 on the non-actuation side 16 of the lever 6 relative to the axis of rotation 8 of the lever 6. The connecting element 10 has a recess 49 which is necessary so that the lever 6 can be closed. In addition, the further connecting element 44 is rotatably connected to the lever 6 on the actuation side 15 of the lever 6. On the other hand, the further connecting element 44 is rotatably connected to the sleeve 23 of the mating plug connector housing 3. The rotatable connections can be implemented by means of pins and the corresponding openings.

Figure 12:
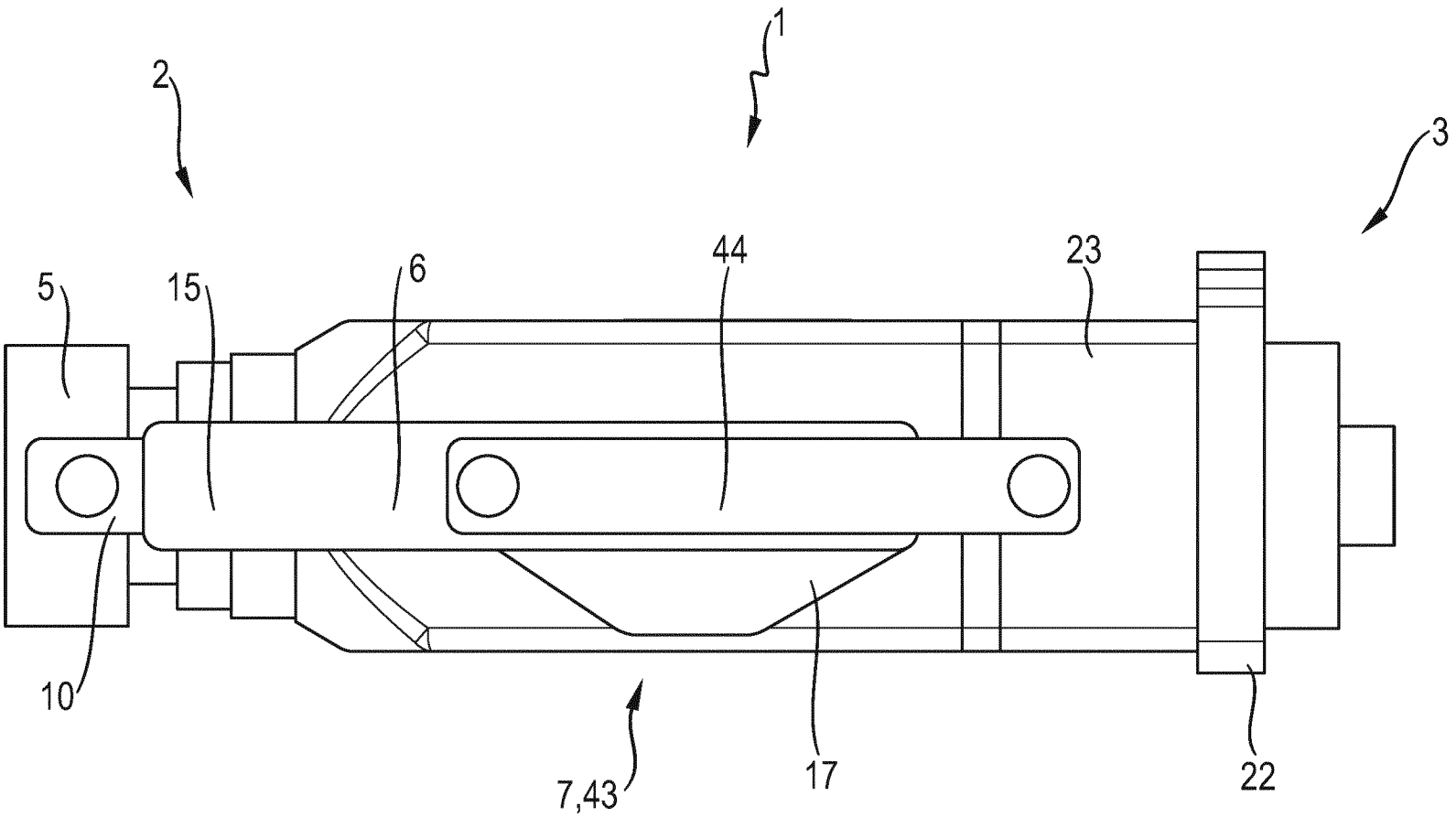
FIG. 12 shows a side view of the plug connection from FIG. 11 in the locked state.

FIG. 12 shows a side view of the plug connection 1 from FIG. 11 in the locked state.

Figure 13:
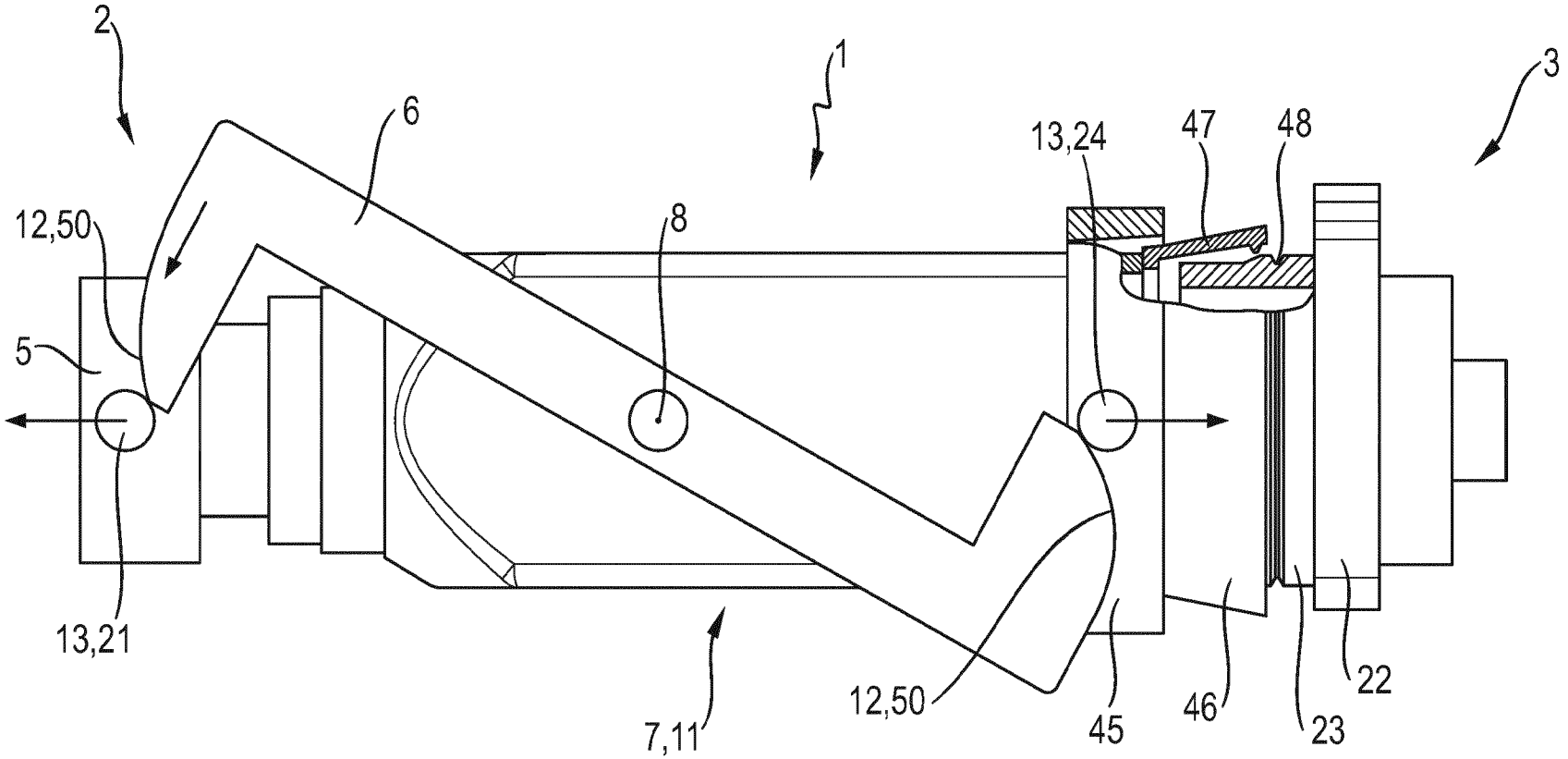
FIG. 13 shows a side view and partial sectional view of a plug connection in the unlocked state.

FIG. 13 shows a side view and a partial sectional view of a plug connection 1 in the unlocked state. In the embodiment in FIG. 13, the gear mechanism 7 has a cam mechanism 11. Both ends of the lever 6 have a curved guide 12. Each curved guide 12 is formed by a curved contour 50 of the lever 6. The curved contour 50 constitutes an outer contour. The curved guide 12 interacts with a guide element 13. The guide elements 13 are designed as pins 21, 24 respectively.

When the lever 6 is closed, the sleeve 5 is displaced in the mating plug-in direction in order to fix the cable 26. The further sleeve 45 is pushed onto the spring cage 46 in order to lock the plug connector housing 2 with the mating plug connector housing 3.

Figure 14:
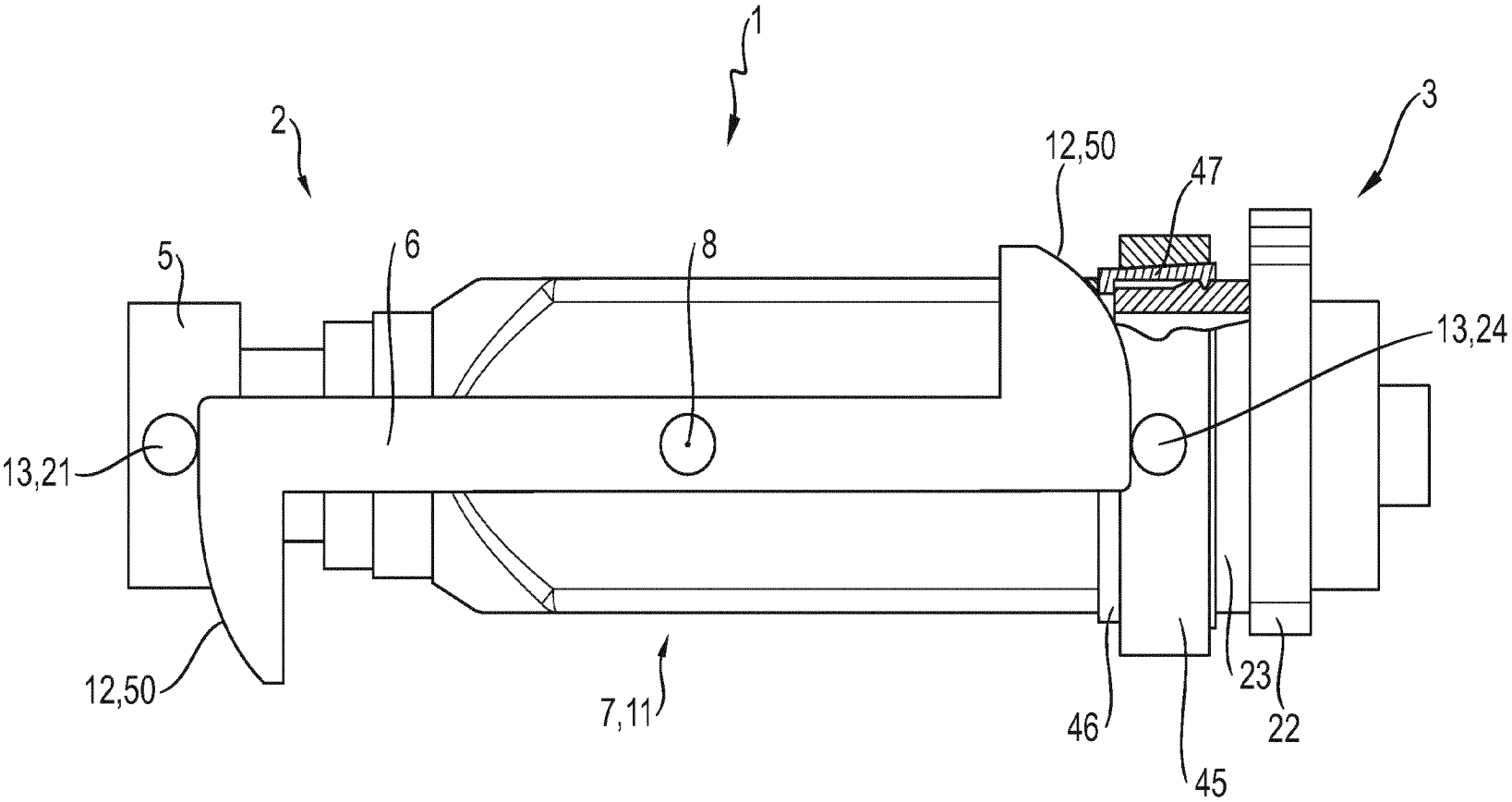
FIG. 14 shows a side view and partial sectional view of the plug connection from FIG. 13 in the locked state.

FIG. 14 shows a side view and partial sectional view of the plug connection 1 from FIG. 13 in the locked state.

Figure 15:
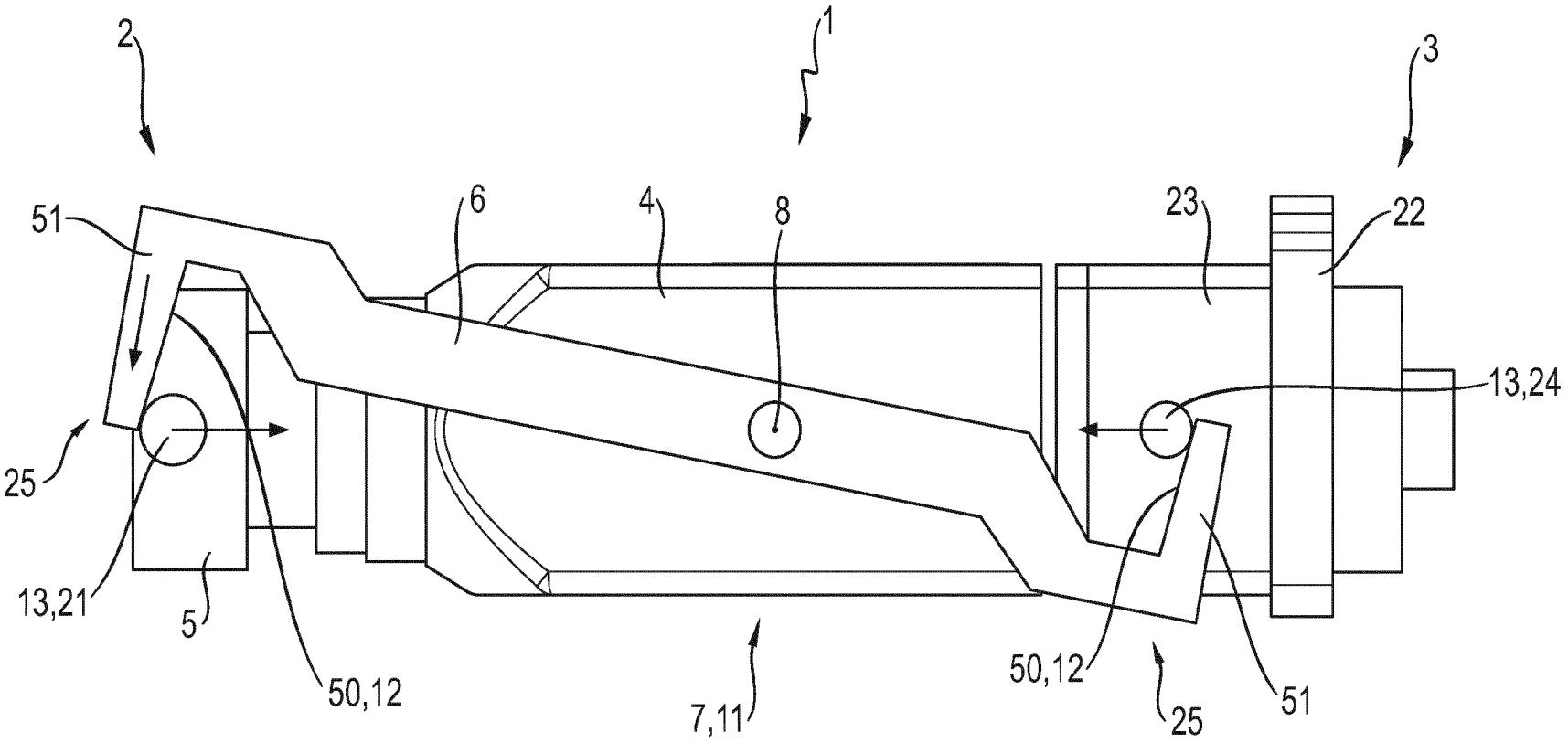
FIG. 15 shows a side view of a plug connection in the unlocked state.

FIG. 15 shows a side view of a plug connection 1 in the unlocked state. In contrast to the embodiment shown in FIGS. 13 and 14, in the embodiment in FIG. 15 the ends of the lever 6 are designed as hooks 25. The hooks 25 each have a wedge-shaped region 51. The wedge-shaped region 51 comprises the curved contour 50. The curved contour 50 constitutes the curved guide 12 of the cam mechanism 11. The curved contour 50 interacts with the guide element 13.

When the lever 6 is closed, then the sleeve 5 is moved in the plug-in direction due to the interaction of the hook 25 and the pin 21 in order to fix the cable 26. Furthermore, the pin 24 is pulled by the other hook 25 in the mating plug-in direction in order to lock the plug connector housing 2 with the mating plug connector housing 3.

Figure 16:
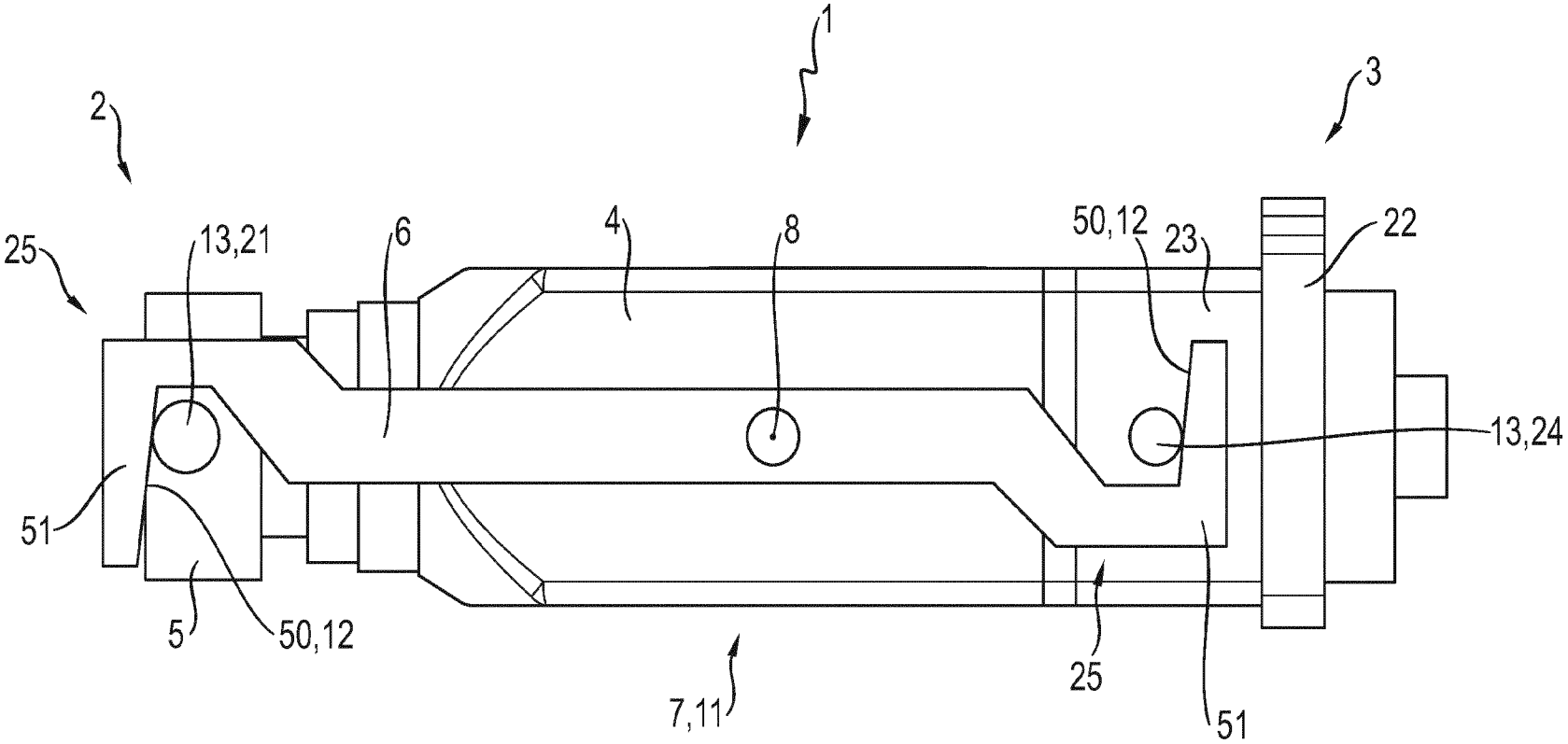
FIG. 16 shows a side view of the plug connection from FIG. 15 in the locked state.

FIG. 16 shows a side view of the plug connection 1 from FIG. 15 in the locked state.

The gear mechanisms 7 shown in FIGS. 9 to 16 are designed, for example, so that when the lever 6 is opened the fixing of the cable 26 is released first, and only then is the plug connector housing 2 unlocked from the mating plug connector housing 3. In the embodiments of FIGS. 9 to 16, the rotatable connections can be implemented, for example, by means of pins and bores.

LIST OF REFERENCE SYMBOLS:

1 plug connection
2 plug connector housing
3 mating plug connector housing
4 housing
5 sleeve
6 lever
7 gear mechanism
8 axis of rotation
9 first pin
10 connecting element
11 cam mechanism
12 curved guide
13 guide element
14 slot
15 actuation side
16 non-actuation side
17 first end of the connecting element
18 second pin
19 second end of the connecting element
20 opening
21 third pin
22 fastening element
23 sleeve of the mating plug connector housing
24 fourth pin
25 hook
26 cable
27 cable-side end of the housing
28 plug-side end of the housing
29 strain relief element
30 opening
31 arrow
32 arrow
33 resilient element
34 arrow
35 arrow
36 gear train mechanism
37 wheel element
38 gear train
39 toothed rack
40 guide element
41 further toothed rack
42 further guide element
43 crank mechanism
44 further connecting element
45 further sleeve
46 spring cage
47 spring element
48 recess
49 recess of the connecting element
50 curved contour
51 wedge-shaped region
52 arrow
53 hook element While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug connector housing comprising:
a housing;
a sleeve arranged movably relative to the housing; and
a lever being mounted on the housing for rotation about an axis of rotation extending perpendicularly to a plug-in direction of the plug connector housing,
wherein the sleeve can be displaced in the plug-in direction in order to fix a cable by a rotary movement of the lever and the plug connector housing can be locked with a mating plug connector housing by the rotary movement of the lever, the housing having a cable-side end and a plug-side end and a strain relief element having an opening for passing through the cable being arranged at the cable-side end of the housing, such that the sleeve is at least partially pushed onto the strain relief element in order to exert radial pressure on the strain relief element relative to the plug-in direction.

2. The plug connector housing of claim 1, wherein an inner lateral surface of the sleeve is tapered and/or wherein an outer lateral surface of the strain relief element is tapered.

3. The plug connector housing of claim 1, including a hook for engaging around a pin or a spring cage having at least one spring element for engaging in a recess of a sleeve of the mating plug connector housing.

4. The plug connector housing of claim 1, wherein the sleeve is displaceable in a direction facing the housing in order to exert the radial pressure on the strain relief element, or wherein the sleeve is displaceable in a direction facing away from the housing in order to exert the radial pressure on the strain relief element.

5. The plug connector housing of claim 4, wherein an inner lateral surface of the sleeve is tapered and/or wherein an outer lateral surface of the strain relief element is tapered.

6. The plug connector housing of claim 1, wherein the plug connector housing has a gear mechanism in order to convert the rotary movement of the lever into displacement of the sleeve.

7. The plug connector housing of claim 6, wherein the plug connector housing has the gear mechanism in order to convert the rotary movement of the lever into locking of the plug connector housing with the mating plug connector housing.

8. The plug connector housing of claim 6, wherein the gear mechanism has a translation in order to release the cable by displacing the sleeve before unlocking the plug connector housing from the mating plug connector housing or in order to release the cable by displacing the sleeve after the plug connector housing has been unlocked from the mating plug connector housing.

9. The plug connector housing of claim 8, wherein the gear mechanism has a cam mechanism, and wherein the cam mechanism comprises a curved guide and a guide element interacting with the curved guide.

10. The plug connector housing of claim 8, wherein the gear mechanism has a crank mechanism, and wherein the crank mechanism comprises at least one connecting element which is rotatably attached at a first end to the lever and is rotatably attached at a second end to the sleeve.

11. The plug connector housing of claim 8, wherein the gear mechanism has a gear train mechanism, and wherein the gear train mechanism comprises at least one wheel and at least one wheel element cooperating with the wheel.

12. The plug connector housing of claim 6, wherein the gear mechanism has a cam mechanism, and wherein the cam mechanism comprises a curved guide and a guide element interacting with the curved guide.

13. The plug connector housing of claim 12, wherein the curved guide is designed as a link, and wherein the guide element is designed as a pin.

14. The plug connector housing of claim 12, wherein the curved guide is designed as a curved contour, and wherein the guide element is designed as a pin.

15. The plug connector housing of claim 6, wherein the gear mechanism has a crank mechanism, and wherein the crank mechanism comprises at least one connecting element which is rotatably attached at a first end to the lever and is rotatably attached at a second end to the sleeve.

16. The plug connector housing of claim 15, wherein the at least one connecting element is attached at the first end to the lever on an actuation side of the lever with respect to the axis of rotation of the lever or wherein the at least one connecting element is attached at the first end to the lever on a non-actuation side of the lever with respect to the axis of rotation of the lever.

17. The plug connector housing of claim 6, wherein the gear mechanism has a gear train mechanism, and wherein the gear train mechanism comprises at least one wheel and at least one wheel element cooperating with the wheel.

18. A plug arrangement comprising:

a plug connector housing including:

a housing;

a sleeve arranged movably relative to the housing; and a lever being mounted on the housing for rotation about an axis of rotation extending perpendicularly to a plug-in direction of the plug connector housing;

wherein the sleeve can be displaced in the plug-in direction in order to fix a cable by a rotary movement of the lever and the plug connector housing can be locked with a mating plug connector housing by the rotary movement of the lever, the housing having a cable-side end and a plug-side end and a strain relief element having an opening for passing through the cable being arranged at the cable-side end of the housing, such that the sleeve is at least partially pushed onto the strain relief element in order to exert radial pressure on the strain relief element relative to the plug-in direction; and a plug connector.

19. A plug connection comprising:

a plug connector housing including:

a housing;

a sleeve arranged movably relative to the housing; and a lever being mounted on the housing for rotation about an axis of rotation extending perpendicularly to a plug-in direction of the plug connector housing;

wherein the sleeve can be displaced in the plug-in direction in order to fix a cable by a rotary movement of the lever and the plug connector housing can be locked with a mating plug connector housing by the rotary movement of the lever, the housing having a cable-side end and a plug-side end and a strain relief element having an opening for passing through the cable being arranged at the cable-side end of the housing, such that the sleeve is at least partially pushed onto the strain relief element in order to exert radial pressure on the strain relief element relative to the plug-in direction; and a mating plug connector housing for connecting to the plug connector housing.

* * * * *